US005785366A

United States Patent [19]

Takaishi et al.

[11] Patent Number: 5,785,366

[45] Date of Patent: Jul. 28, 1998

[54] DOOR LOCK DEVICE

[75] Inventors: Tatsuyuki Takaishi; Masazumi Miyagawa, both of Yokohama, Japan

[73] Assignee: Ohi Seisakusho Co., Ltd., Yokohama, Japan

[21] Appl. No.: 639,998

[22] Filed: Apr. 30, 1996

Related U.S. Application Data

[63] Continuation of Ser. No. 291,472, Aug. 17, 1994, abandoned.

[30] Foreign Application Priority Data

Nov. 30, 1993 [JP] Japan ..... 5-299549

[51] Int. Cl.[6] ..... E05B 15/02

[52] U.S. Cl. ..... 292/341.12; 292/216; 292/DIG. 38

[58] Field of Search ..... 292/341.12, 198, 292/216, 336.3, DIG. 23, DIG. 38, DIG. 73, 341.11

[56] References Cited

U.S. PATENT DOCUMENTS

| | | | |
|---|---|---|---|
| 3,705,738 | 12/1972 | Yoshimura | 292/341.12 X |
| 3,858,919 | 1/1975 | Kleefeldt et al. | 292/DIG. 38 X |
| 4,235,462 | 11/1980 | Torii et al. | 292/216 |
| 4,538,845 | 9/1985 | Yamada | 292/216 |
| 4,775,176 | 10/1988 | Ikeda | 292/DIG. 38 X |
| 4,856,829 | 8/1989 | Nakamura et al. | 292/216 |
| 4,896,908 | 1/1990 | Kleefeldt et al. | 292/DIG. 38 X |
| 4,969,673 | 11/1990 | Portelli et al. | 292/216 |
| 4,988,135 | 1/1991 | Ottino | 292/216 X |
| 5,046,341 | 9/1991 | Ogino et al. | 292/216 X |
| 5,064,229 | 11/1991 | Hamada et al. | 292/341.12 X |
| 5,273,325 | 12/1993 | Zimmerman | 292/336.3 X |
| 5,277,461 | 1/1994 | Dzurko et al. | 292/336.3 X |
| 5,308,128 | 5/1994 | Portelli et al. | 292/216 |
| 5,328,219 | 7/1994 | Konchan et al. | 292/DIG. 38 X |

FOREIGN PATENT DOCUMENTS

| | | |
|---|---|---|
| 2 061 369 | 5/1981 | United Kingdom . |
| 2 213 192 | 8/1989 | United Kingdom . |

*Primary Examiner*—Rodney M. Lindsey
*Attorney, Agent, or Firm*—Foley & Lardner

[57] ABSTRACT

A door lock device is described, which has a recessed body having an outside surface. The body has an opening through which the interior of the body is exposed to a back side of the body which faces the outside surface. A latch lever is pivotally installed in the body and engageable with a striker. A locking lever is pivotally installed in the body and operatively engageable with the latch lever. An extra lever is pivotally connected to the outside surface of the body and has an opening formed therethrough. A metal pin is secured to the locking lever and projects toward the back side of the body through the opening of the body and is slidably and pivotally engaged with the opening of the extra lever. A plastic layer entirely covers the pin.

10 Claims, 3 Drawing Sheets

DOOR LOCK DEVICE

This application is a continuation of application Ser. No. 08/291,472, filed Aug. 17, 1994 now abandoned.

BACKGROUND OF THE INVENTION

1. Field of the Invention

The present invention relates in general to door lock devices, and more particularly to door lock devices of a type which generally comprises a latch lever engageable with a striker to latch the same and a locking lever engageable with the latch lever to lock the same.

2. Description of the Prior Art

In door lock devices, there is a type which comprises a body, a latch lever pivotally installed in the body and engageable with a striker to latch the same, a locking lever pivotally installed in the body and engageable with the latch lever to lock the same, and a metal pin fixed to either the latch lever or the locking lever to actuate the same when applied with a force from an external operation lever. The operation lever is installed on a rear surface of the body and thus the body is formed with an opening through which the metal pin is projected rearward to engage with the operation lever.

In order to tightly fix the metal pin to the locking lever (or latch lever), two techniques have been commonly used. One is a technique in which the pin is inserted into an opening formed in the locking lever and then caulked at its leading end, and the other is a technique in which the pin is serrated and press-fitted into an opening formed in the locking lever.

However, usage of the caulking process and serrating process causes an increase in cost. Furthermore, since the pin is a metal pin and naked, the same produces an uncomfortable noise when brought into contact with an associated part upon operation of the door lock device.

SUMMARY OF THE INVENTION

It is therefore an object of the present invention to provide a door lock device which is free of the above-mentioned drawbacks.

According to a first aspect of the present invention, there is provided a door lock device which comprises a recessed body having an outside surface, the body having an opening through which the interior of the body is exposed to a back side of the body which faces the outside surface; a latch lever pivotally installed in the body, the latch lever being engageable with a striker; a locking lever pivotally installed in the body and operatively engageable with the latch lever; an extra lever pivotally connected to the outside surface of the body; a metal pin secured to one of the latch lever and the locking lever, the pin projecting toward the back side of the body through the opening of the body and being operatively with the extra lever; and a plastic layer covering the entire of the pin.

According to a second aspect of the present invention, there is provided a door lock device for use in a motor vehicle. The door lock device comprises a recessed body adapted to be mounted on a body of the vehicle, the recessed body having an outside surface and an elongate opening through which the interior of the body is exposed to a back side of the recessed body which faces the outside surface; a latch lever pivotally installed in the recessed body, the latch lever being engageable with a striker adapted to be mounted to a door of the vehicle; a locking lever pivotally installed in the recessed body to selectively lock and unlock the latch lever; an extra lever pivotally connected to the outside surface of the recessed body; a metal pin secured to the locking lever and projecting toward the back side of the body through the elongate opening of the body to be slidably and operatively engaged the extra lever; and a plastic layer covering the entire of the pin and that of the locking lever, wherein the elongate opening is so sized and shaped to induce a contact of the pin with an end of the elongate opening during movement of the pin in the elongate opening.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
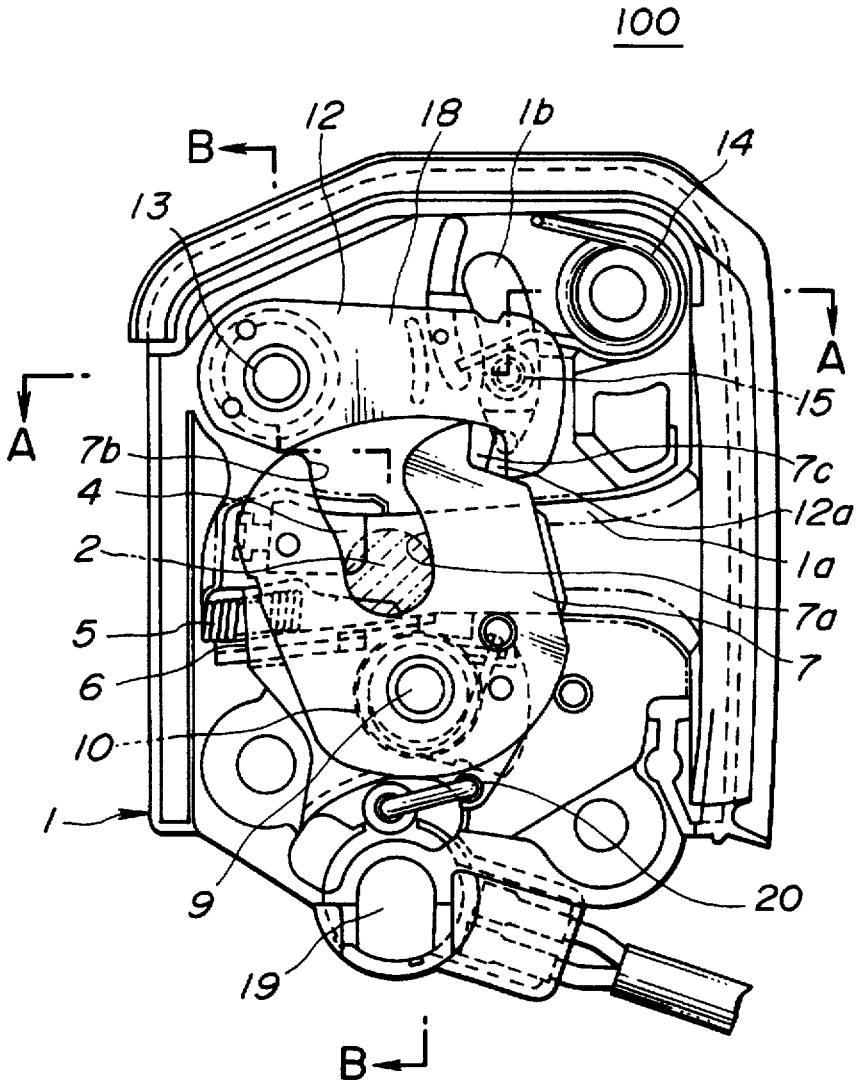
FIG. 1 is a front view of a door lock device of the present invention with a cover plate removed.

Referring to the drawings, particularly FIG. 1, there is shown a door lock device according to the present invention, which is generally designated by numeral 100.

As is best seen from FIG. 1, the door lock device 100 comprises a recessed body 1 constructed of a plastic. Although not shown, the body 1 is secured to a free end of a pivotal door of a motor vehicle. The body 1 is formed at its middle portion with a guide groove 1*a* into which a striker 2 secured to a body of the vehicle is inserted upon closing of the door. The body 1 has, above the guide groove 1*a*, an arcuate slot 1*b* which is elongated in a vertical direction as shown.

Figure 4:
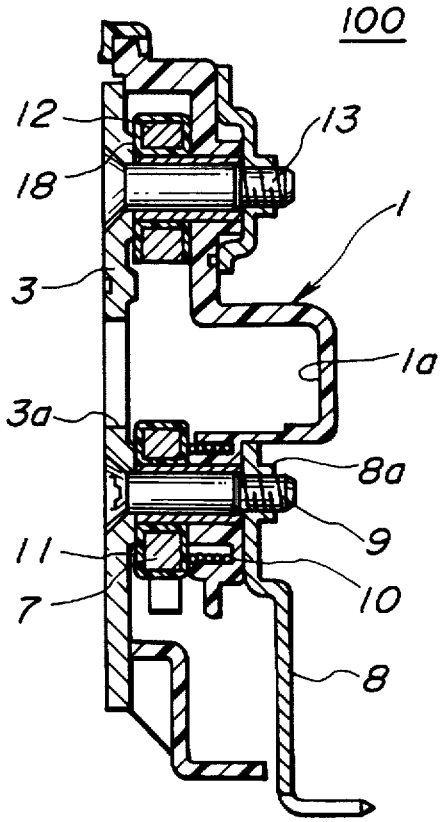
FIG. 4 is a sectional view taken along the line B—B of FIG. 1.

As is seen from FIG. 4, the open side of the recessed body 1 is covered by a metal cover plate 3 bolted to the body 1. The cover plate 3 is formed, at a portion facing the guide groove 1*a* of the body 1, with an elongate cut 3*a*. In fact, due to provision of this cut 3*a*, insertion of the striker 2 into the guide groove 1*a* is made possible.

As is seen from FIG. 1, at the inner portion of the guide groove 1*a*, there are installed a bumper rubber 4 and a wedge-shaped striker gripper 6. The bumper rubber 4 is fixed to the body 1. That is, when, upon closing of the door, the striker 2 is inserted deeply into the guide groove 1*a*, the striker 2 abuts against the bumper rubber 4 and thus the inward movement of the striker 2 is stopped while damping the impact shock of the striker 2. The wedge-shaped striker gripper 6 is biased outward by a spring 5 fixed to the body 1. Thus, when the striker 2 is inserted deeply into the guide groove 1*a*, the striker 2 pushes the striker gripper 6 against the force of the spring 5 and finally rides on an inclined surface of the gripper 6. With this, the striker 2 is tightly but resiliently sandwiched between the striker gripper 6 and the bumper rubber 4, so that undesirable play of the striker 2, that is, the play of the door in the closed position is suppressed.

Designated by numeral 7 in FIG. 1 is a metal latch lever which is pivotally connected to the body 1 by means of a bolt 9. For selective engagement with the striker 2, the latch lever 7 has a latch recess 7*a* defined between two tongue portions thereof. That is, the latch lever 7 is pivotal to assume a full-latch position wherein, as shown in FIG. 1, the latch lever 7 is fully engaged with the striker 2, a half-latch position wherein the latch lever 7 is incompletely engaged with the striker 2 and a release position wherein the latch lever 7 releases the striker 2. For releasing the striker 2, the latch lever 7 is pivoted clockwise from the full or half-latch position in FIG. 1. A coil spring 10 is disposed about the bolt 9 to bias the latch lever 7 in a clockwise direction, that is, toward the release position. The two tongue portions of the latch lever 7 have first and second engaging portions **7*b* and 7*c* respectively. The entire of the latch lever 7 except for the second engaging portion 7*c* is lined with a plastic layer 11**.

As will be seen from FIG. 4, the bolt 9 has an inward end screwed into a threaded opening **8*a* formed in a metal base plate 8 which is secured to a rear surface of the body 1. As is seen from FIGS. 2 and 3, the base plate 8 is formed, at a portion facing the arcuate slot 1*b* of the body 1, with an identical arcuate slot 8*b***.

Referring back to FIG. 1, denoted by numeral 12 is a metal locking lever which is pivotally connected through a bolt 13 between the body 1 and the cover plate 3. Due to a coil spring 14 mounted in the body 1, the locking lever 12 is biased to rotate in a counterclockwise direction about the bolt 13. The locking lever 12 has a free end formed with a pawl portion **12*a* which is engageable with the first and second engaging portions 7*b* and 7*c* of the latch lever 7**.

The locking lever 12 is formed near the pawl portion **12*a* with an opening 12*b* into which an end of a spring pin 15 is press-fitted. The spring pin 15 is a metal pin which is hollow and cylindrical in shape and has an axially extending slit therethroughout. As is understood from FIGS. 1 and 2, the spring pin 15 projects rearward through the mated arcuate slots 1*b* and 8*b***.

As will be seen from FIG. 1, the locking lever 12 is pivotal between an engaging position wherein, as shown, the pawl portion **12*a* of the locking lever 12 is engaged with the first or second engaging portion 7*b* or 7*c* of the latch lever 7 and a release position wherein the pawl portion 12*a* releases the first and second engaging portions 7*b* and 7*c*. For releasing the latch lever 7, the locking lever 12** is pivoted counterclockwise from the engaging position.

It is to be noted that when the pawl portion **12*a* of the locking lever 12 is in engagement with the second engaging portion 7*c* of the latch lever 7, the latch lever 7 assumes the full-latch position as shown in FIG. 1, and when the pawl portion 12*a* is in engagement with the first engaging portion 7*b*, the latch lever 7 assumes the half-latch position. While, when the locking lever 12 assumes the release position against the force of the spring 14, the latch lever 7 is permitted to pivot to assume the release position due to the force of the coil spring 10**.

When the vehicle door is fully open, the latch lever 7 assumes the release position. Under this condition, the pawl portion **12*a* of the locking lever 12 rides on an opposed side of the first engaging portion 7*b* of the latch lever 7 and the latch recess 7*a* of the latch lever 12 is directed toward an inlet part of the guide groove 1*a* of the body 1. Thus, when, upon closing of the door, the striker 2 is strongly led into the guide groove 1*a*, the striker 2 is put into the latch recess 7*a* of the latch lever 7 causing the latch lever 7 to pivot to the full-latch position as shown in FIG. 1. If the door closing force is not so strong, the latch lever 7** is stopped at the half-latch position.

It is to be noted that when the latch lever 7 assumes the full-latch or half-latch position holding the striker 2, the door is fully latched or incompletely latched at its closed position with respect to the vehicle body.

As has been mentioned hereinabove, the spring pin 15 projects to the rear side of the body 1 through the mated arcuate slots **1*b* and 8*b* (see FIGS. 1 and 2**).

Figure 3:
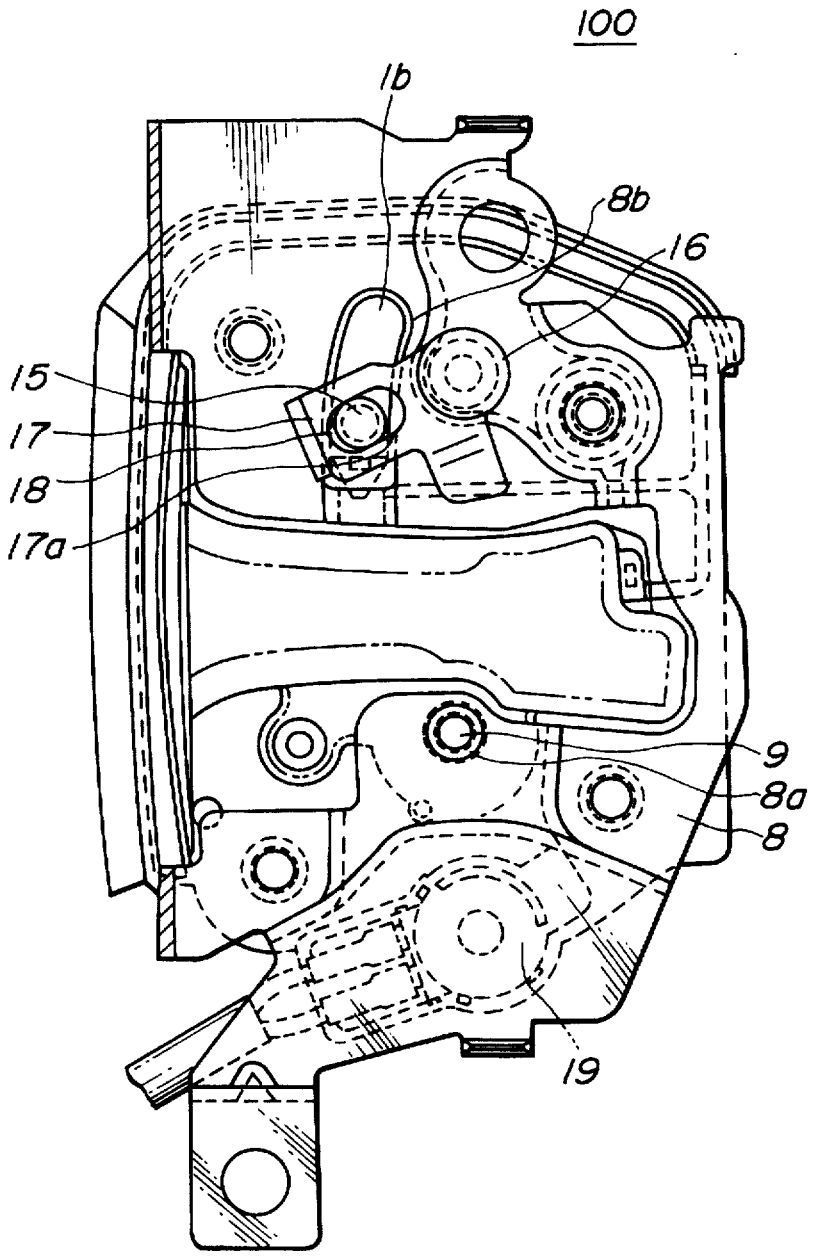
FIG. 3 is a back view of the door lock device of the invention.

As is seen from FIG. 3, the rearward leading end of the spring pin 15 is slidably and pivotally engaged with an elongate slot **17*a* formed in an open lever 17 which is pivotally connected through a shaft 16 to a rear surface of the base plate 8. Thus, when the open lever 17 is pivoted about the shaft 16, the spring pin 15 is forced to move along and in the mated arcuate slots 1*b* and 8*b* pivotally moving the locking lever 12. That is, in response to the pivotal movement of the open lever 17, the locking lever 12** is forced to pivot between the engaging position and the release position.

In FIG. 1, denoted by numeral 19 is a door switch which is operatively connected through a link 20 to the latch lever 7 to sense the position of latch lever 7, that is, the open/close condition of the associated door.

In the present invention, the following measure is employed, which can solve the drawbacks of the above-mentioned conventional door lock devices.

Figure 2:
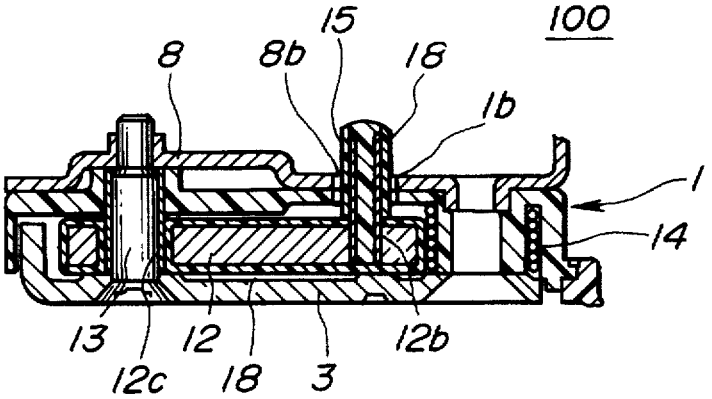
FIG. 2 is a sectional view taken along the line A—A of FIG. 1.

That is, as is seen from FIG. 2, the entire of the locking lever 12 and that of the spring pin 15 except for the pawl portion **12*a* of the locking lever 12 are lined with a plastic layer 18 which is constructed of NYLON (trade name) or the like. For this plastic lining, an insert molding technique is employed. Because the spring pin 15 is of a hollow member and has the axially extending slit, the hollow of the pin 15 becomes filled with the plastic at the molding process. Preferably, the thickness of the plastic layer 18 on the locking lever is about 0.7 mm, and the thickness of the plastic layer 18 on the spring pin 15** is about 0.75 mm.

In the following, advantages of the present invention will be described.

First, since the spring pin 15 is lined with a plastic, the pin is prevented from producing an uncomfortable noise even when the same is brought into contact with a neighboring part. In fact, during operation of the door lock device, the pin 15 is forced to strongly strike a lower end of the arcuate slot **1*b* of the body 1 with an aid of the spring 14. That is, the noise is damped by the plastic layer 18**.

Second, because both the locking lever 12 and the spring pin 15 are substantially entirely covered with the plastic layer 18, coupling of the pin 15 with the locking lever 12 is assured.

Third, because the interior of the hollow pin 15 is filled with the plastic, the rigidity of the pin is increased. This construction promotes the feature of the above-mentioned first advantage.

Although the foregoing description is directed to an embodiment wherein the spring pin 15 is fixed to the locking lever 12, the present invention may be applied to another embodiment wherein the spring pin 15 is fixed to the latch lever 7. In this embodiment, the latch lever 7 and the spring 15 are entirely lined with a plastic layer.

What is claimed is:

1. A door lock device comprising:

a recessed body having an outside surface, said recessed body having an opening extending from the interior of said recessed body to said outside surface;

a metal latch lever pivotally mounted to said recessed body, said latch lever being engageable with a striker inserted into said recessed body;

a metal locking lever pivotally mounted to said recessed body and engageable with said latch lever;

an extra lever pivotally mounted to said outside surface of said recessed body;

a metal pin having one end secured to one of said latch lever and said locking lever, said metal pin projecting to the outside of said recessed body through said opening of said recessed body thereby to engage the other end thereof with said extra lever; and a plastic layer covering both said metal pin and the selected one of said latch lever and said locking lever in a manner to increase a mechanical connection therebetween, said plastic layer continuously extending from at least the other end of said metal pin to said selected one of said latch lever and said locking lever.

2. A door lock device as claimed in claim 1, in which the opening of said body is adapted to induce a contact of said metal pin with an end of the opening of said recessed body during operation of said door lock device.

3. A door device as claimed in claim 2, in which said extra lever is formed with an opening with which the other end of said metal pin is slidably and pivotally engaged.

4. A door lock device as claimed in claim 1, in which said metal pin is hollow and cylindrical in shape and has an axially extending slit therethroughout, the interior of the hollow pin being filled with the plastic.

5. A door lock device as claimed in claim 1, in which said pin is secured to said selected one of said latch lever and said locking lever by means of press fitting technique.

6. A door lock device as claimed in claim 5, in which said selected one of said latch lever and said locking lever is formed with an opening into which the one end of said metal pin is press-fitted.

7. A door lock device as claimed in claim 5, in which said pin and said selected one of said latch lever and said locking lever are substantially entirely covered with said plastic layer.

8. A door lock device as claimed in claim 7, in which the covering of the plastic layer over said pin and said selected one of said latch lever and said locking lever is made by means of an insert molding technique.

9. A door lock device as claimed in claim 1, in which the plastic layer is constructed of NYLON.

10. A door lock device for use in a motor vehicle, comprising:

a recessed body adapted to be mounted to a body of the vehicle, said recessed body having an outside surface an elongate opening extending from the interior of said recessed body to said outside surface;

a metal latch lever pivotally mounted to said recessed body, said latch lever being engageable with a striker mounted on a door of the vehicle;

a metal locking lever pivotally mounted to said recessed body to selectively lock and unlock said latch lever;

an extra lever pivotally mounted to said outside surface of said recessed body, said extra lever having an opening formed therethrough;

a metal pin having one end secured to said locking lever, said metal pin projecting to the outside of said recessed body through said elongate opening of said recessed body thereby to engage the other end thereof with said extra lever;

a plastic layer covering both said metal pin and said locking lever in a manner to increase the mechanical connection therebetween, said plastic layer continuously extending from at least the other end of said metal pin to said locking lever, wherein said elongate opening is adapted to induce contact of said metal pin with an end of said elongate opening during movement of said pin in said elongate opening.

* * * * *